US005821488A

United States Patent [19]

Falcon

[11] Patent Number: 5,821,488

[45] Date of Patent: Oct. 13, 1998

[54] CABLE ACTUATED SWITCHING MECHANISM WITH MECHANICAL SNAP ACTION CAPABILITY AND BROKEN CABLE MONITORING CAPABILITY

[75] Inventor: David E. Falcon, Oak Creek, Wis.

[73] Assignee: Honeywell Inc., Minneapolis, Minn.

[21] Appl. No.: 738,505

[22] Filed: Oct. 24, 1996

[51] Int. Cl.[6] ..... H01H 9/00

[52] U.S. Cl. ..... 200/52 R; 200/61.18

[58] Field of Search ..... 200/52 R, 61.14, 200/61.18, 61.39, 61.44

[56] References Cited

U.S. PATENT DOCUMENTS

| | | | |
|---|---|---|---|
| 3,870,846 | 3/1975 | Filip . | |
| 3,956,606 | 5/1976 | Reiter . | |
| 4,306,126 | 12/1981 | Howard | 200/52 R |
| 4,396,815 | 8/1983 | Kobayashi et al. . | |
| 4,458,122 | 7/1984 | Knight | 200/153 LA |
| 4,807,829 | 2/1989 | Zollinger | 242/152.1 |
| 5,003,135 | 3/1991 | Piccoli . | |
| 5,041,705 | 8/1991 | Piccoli | 200/52 R |
| 5,574,265 | 11/1996 | Falcon | 200/61.44 |

*Primary Examiner*—Matthew V. Nguyen
*Attorney, Agent, or Firm*—William D. Lanyi; John G. Shudy, Jr.

[57] ABSTRACT

A cable operated switching mechanism is provided with a positive locking method that latches a cam structure in place after the cable is pulled by an operator and does not permit the cam structure to return to its normal operating position until manual intervention is used to push a reset plunger. The cable operated switching mechanism provides this positive stop by incorporating a tab on a latching device which is associated with the reset plunger and moves with it when a reset button is pushed by an operator. The tab of the latching device slides along a first surface of the cam structure until the cable is pulled to activate the mechanism. Then, under the influence of a spring, the latching device moves upward to cause the tab to move into a blocking position relative to a second surface of the cam structure. The prevents the cam structure from moving from its actuated position to its normal operating position until a reset button is pushed. This mechanism overcomes a possible problem wherein a loosely assembled cable, with too much slack, could otherwise allow a switch to be activated by the mechanism following deactivation by an operator pulling the cable.

20 Claims, 10 Drawing Sheets

Fig. 4A
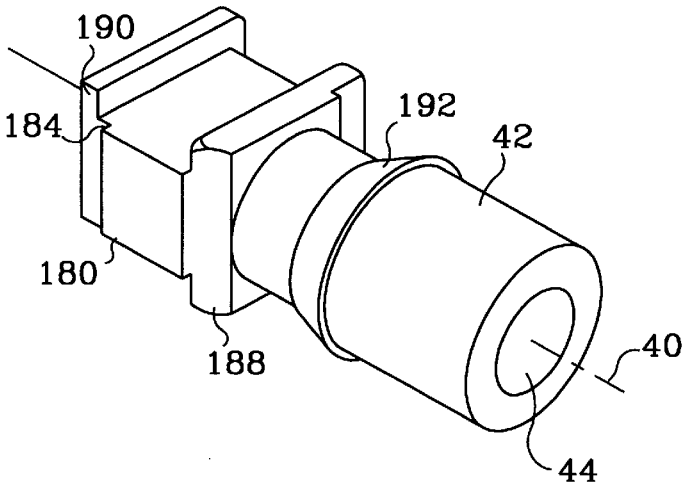
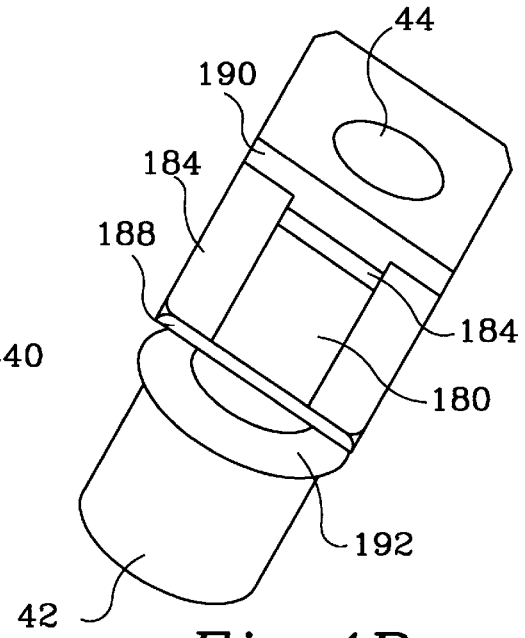
Fig. 4B
Fig. 5A
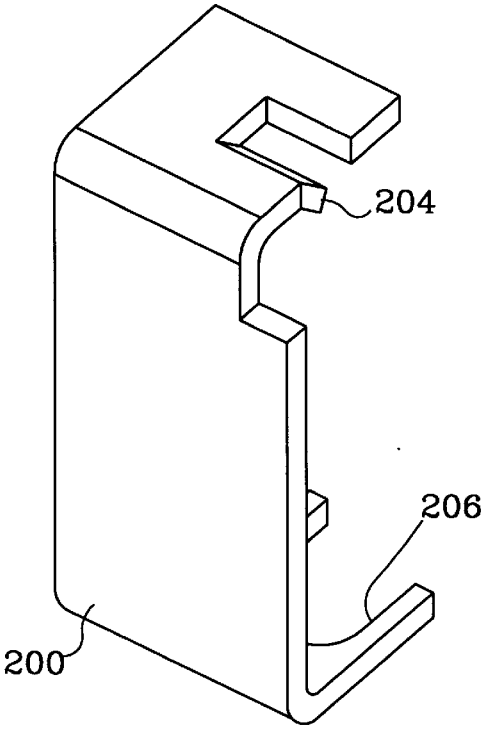
Fig. 5B
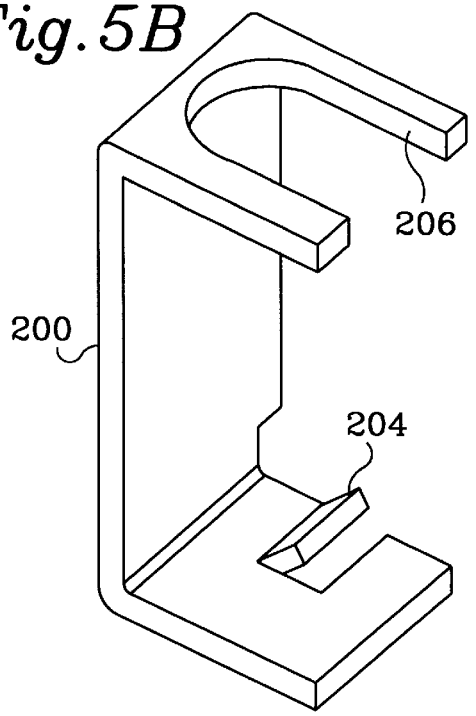

CABLE ACTUATED SWITCHING MECHANISM WITH MECHANICAL SNAP ACTION CAPABILITY AND BROKEN CABLE MONITORING CAPABILITY

BACKGROUND OF THE INVENTION

1. Field of the Invention

The present invention is generally related to cable actuated switches and, more specifically, to a cable actuated switching mechanism that is able to lock the mechanism in place upon actuation or in response to a broken cable while avoiding inadvertent reactuation due to improper cable tension adjustments.

2. Description of the Prior Art

Several types of cable actuated switches are known to those skilled in the art. Cable actuated switches are typically used in applications where an emergency stop capability is required along an extended distance. For example, in certain conveyor system applications, it is necessary to provide a means for any one of a number of different human operators to actuate the emergency stop condition from many different locations along the conveyor. Rather than provide numerous emergency stop switches at multiple locations along the equipment, it is economically advantageous to provide a single switch that can be actuated by pulling a cable that extends along the conveyor from the switch to a remote location.

U.S. Pat. No. 3,870,846, which was issued to Filip on Mar. 11, 1975, discloses a cable activated switch that comprises a switch support body that has a through bore. A first switch contact member is retained on the body and a second switch contact member is further slidingly retained on the body and insulated therefrom. Clamping means are provided for securing the cable passing through the bore. First resilient means are provided to bias the contact members. The first and second contact members are displaced relative to each other by predetermined axial movement of the cable which passes through the support body.

U.S. Pat. No. 5,003,135, which issued to Piccoli on Mar. 26, 1991, describes a cable controlled electrical safety switch device that comprises a piston tensioning cable under the action of a spring via a rod and a screw thread for adjusting the tension of the spring and of the cable. A piston groove actuates a push member for the switch. The piston is angularly adjustable. The flank of the groove remote from the spring is helicoidal. When the cable is long, a high tension is selected so that the groove flank moves away from the push member. This distancing is desirable in order that any length variations due to heat, which are greater with a long cable, may be prevented from triggering the switch. The clearance between the other flank and the push member is then corrected by rotation of the piston.

U.S. Pat. No. 4,396,815, which issued to Kobayashi et al on Aug. 2, 1983, discloses an emergency switch for preventing an accident in a mechanism employing a control cable. It comprises a casing having a pair of contacts at opposite inner side surfaces thereof and an insulator member having a movable contact. The insulator member is slideably and axially moved within the casing in connection with tensile force of inner cables. When the inner cables become inoperable because of some problem, the movable contact is touched to the contacts provided on the inner side surfaces of the casing in order to detect the problem or to stop the movement of the mechanism.

U.S. Pat. No. 3,956,606, which issued to Reiter on May 11, 1976, describes a cable operated safety stop switch. The switch unit, which is suitable for use in instances of emergency and also for a normal electrical shut off and resetting of a controlled system, features a snap action electrical switch. The switch can be operated selectively by a pair of like end anchored tension cables which have their inner ends connected to the operating and reset signal arm in order to trip the latter from a normal release position upon a tensioning of either cable by an attendant. The tripping of the arm causes it to operate the snap action switch and the arm is automatically locked in the tripped position thereof. A tensioning of either one of the cables under a force exceeding a very moderate value occasions a limited rotation of a shaft carrying the arm. This actuates the snap action switch and thereby through conventional wiring means initiates an instantaneous cut off of the system's electrical supply. The shaft and the arm are automatically locked in their tripped condition by a locking plate fixed on and rotatable with the shaft. The plate presents locking pins adapted to engage the latch in a fixed keeper plate of the switch unit. The locking plate is axially movable with the shaft in opposition to relatively mild spring bias to disengage the locking pins from the keeper plate. It thereby releases the shaft for normal counter rotation from locked condition to normal release condition.

U.S. patent application Ser. No. 08/575,568,which was filed on Dec. 20, 1995 (M10-16261) by Falcon, discloses an improved cable actuated switching mechanism that avoids many disadvantages that were inherent in the prior art. It describes a cable switch actuating mechanism which is provided with a shaft and a cam structure that slides on the shaft. When the associated cable is pulled to exert an axial force on the shaft, the cam actuator is pushed by the shaft into a deactuating position that moves a switch operator plunger against a plunger of an associated electrical switch. If the cable breaks, the reduction of force on the shaft allows an internal spring to move the shaft against the cam structure and, as a result, move the switch operator into its deactuating position. Appropriate gaps between the opposite ends of the cam structure and associated surfaces of the shaft allow for thermal expansion and contraction of the cable without adverse affects on the mechanism.

Notwithstanding the improvements provided by the mechanism disclosed in patent application Ser. No. 08/575,568, described immediately above, improper installation of the cable can result in a deleterious situation. Under certain conditions, where the cable is improperly installed with insufficient tension, the mechanism can initially respond to an operator pulling the cable and operate properly to actuate its associated switch, but then allow the switch to be subsequently deactuated when the cable is released by the operator. This could result in the momentary stopping of a machine, such as a conveyor system, but be followed by a restarting of the machining when the cable is released. It should be understood that this deleterious situation can only occur if the system is installed improperly with the cable being too slack. It would therefore be beneficial if a cable actuated switching mechanism could be provided which positively locks the mechanism in a switch actuating condition regardless of the possible slackness of the cable because of improper installation.

SUMMARY OF THE INVENTION

A cable operated switching mechanism made in accordance with the present invention comprises a housing structure and a shaft that is slideably disposed within the housing structure. The shaft is movable relative to the housing structure along a first path in a direction parallel to an axial centerline of the shaft in response to a force exerted by a cable attached to the end of the shaft. A cam structure, having an opening formed therethrough, is also provided by the present invention and the opening is shaped to receive the shaft therein in slideable relation with the cam structure. A switch operator is provided which is movable along a second path between a first position and a second position in response to movement of the cam structure in either a first direction or a second direction parallel to the first path. The invention also comprises a means for locking the switch operator in the second position after the switch operator moves into the second position.

As described above, the present invention is an improvement over the cable operated switching mechanism described in U.S. patent application Ser. No. 08/575,568 which was filed on Dec. 20, 1995 (M10-16261) by Falcon. The improvement relates specifically to the provision of a latch device associated with a reset plunger which is movable between a normal operating position and a resetting position, wherein the cam structure is moved by the reset plunger to unlock the switch operator when the reset plunger is moved to the resetting position. The improvement of the present invention relates to the provision of the latch device which has a tab extending from it. The latch device is movable with the reset plunger and the cam structure has a first generally planar surface and a second generally planar surface. The tab is disposed in sliding association with the first surface of the cam structure when the switch operator is in the first position and the tab is disposed proximate the second surface of the cam structure when the switch operator is in the second position in response to the force being exerted by the cable. As a result of the present invention, the cam structure is blocked from moving the switch operator from the second position to the first position when the tab is disposed proximate the second surface unless the reset plunger is moved to its resetting position.

BRIEF DESCRIPTION OF THE DRAWINGS

The present invention will be more fully and completely understood from a reading of the Description of the Preferred Embodiment in conjunction with the drawings, in which:

FIGS. 4A and 4B showed two perspective views of a cam structure used in a preferred embodiment of the present invention;

FIGS. 5A and 5B show two perspective views of a latching device used in a preferred embodiment of the present invention;

DESCRIPTION OF THE PREFERRED EMBODIMENT

Figure 1:
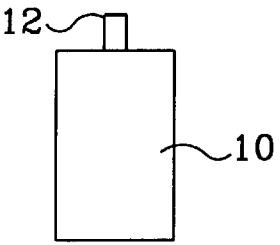
Fig. 1 (PRIOR ART)
FIG. 1 is a schematic representation of a switch that can be used in conjunction with the present invention.

Throughout the Description of the Preferred Embodiment, like components will be identified by like reference numerals.

The present invention is an improvement to the mechanism described and claimed in U.S. patent application Ser. No. 08/575,568 described above. In order to fully understand the improvements provided by the present invention, it is necessary to understand the general operation of the total mechanism. For these reasons, the cable actuated switch mechanism will be described in full even through the present invention is specifically directed toward providing one particular feature that contributes to its improved operation.

FIG. 1 shows a schematic representation of a type of switch that is generally known to those skilled in the art. The switch has a body 10 and a plunger 12 that can be depressed in a direction toward the body 10 in order to activate the switch. In the description of the preferred embodiment, the mechanism of the present invention will be described in terms of its association with a normally closed switch. Therefore, depression of the plunger 12 by the present invention will actuate the switch to disconnect its contacts within its structure and open, or deactivate, an electrical circuit. In contrast, release of the plunger 12 to move outward from its housing under spring actuation provided by the switch will cause the contacts to close and activate an electrical circuit. Switches of the type shown in FIG. 1 are widely known to those skilled in the art and many types of normally closed switches are available in commercial quantities. The switch 10 can be a snap acting switch, but the mechanical locking capability of the present invention is equally applicable with slow acting switches.

Figure 2:
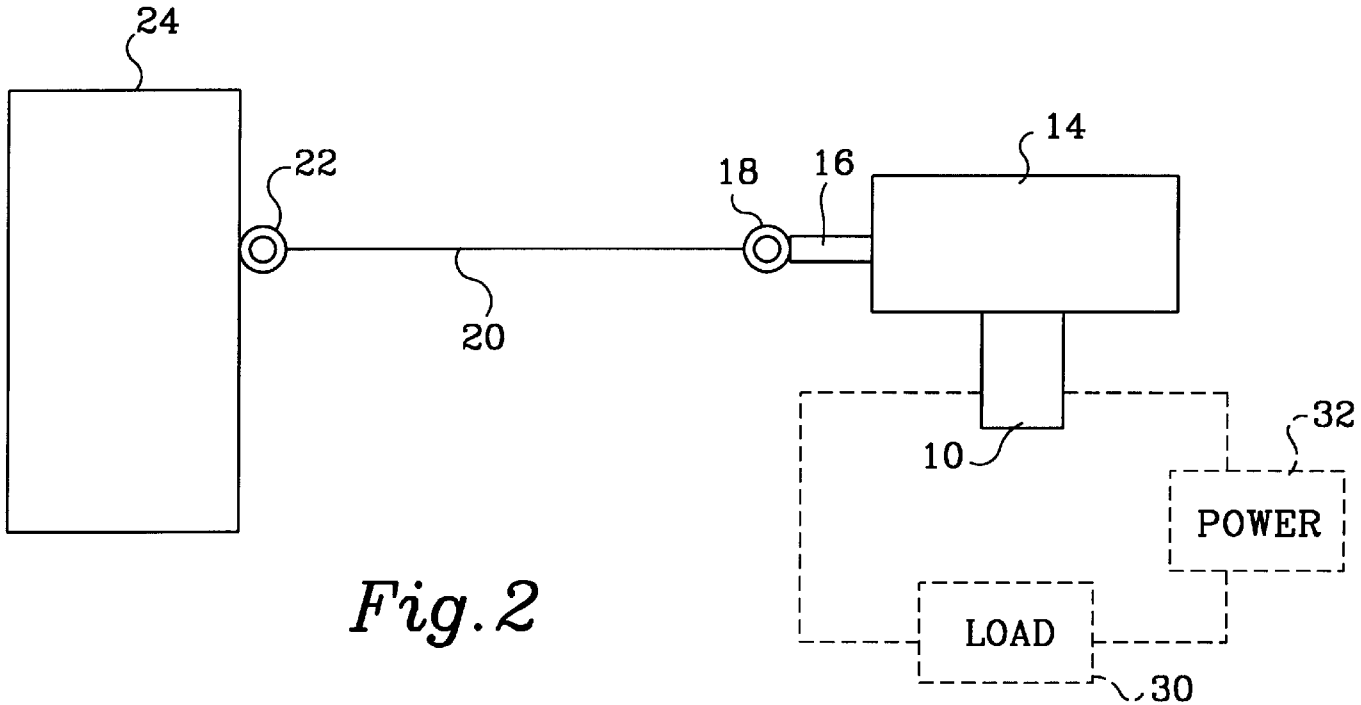
FIG. 2 is a schematic representation of a system incorporating a cable and a cable operated switching mechanism.

FIG. 2 shows a cable operated switching mechanism 14 associated with a switch body 10. A shaft 16 extends from the housing structure 14 of the mechanism. An attachment means 18 is provided for permitting a cable 20 to be attached to the shaft 16. A similar attachment means 22 is provided to permit the cable 20 to be attached to a rigid device 24 which can be a portion of a machine or any other stationary component. The length of the cable 20 can be very long. In some cases, cable actuated switches are used in conjunction with cables that are over 200 feet long. Any operator working near the cable 20 can pull it to deactivate the equipment associated with the switch 10. As an example, a load 30 is shown by dashed lines in FIG. 2 connected in series with the switch 10. When the cable 20 is pulled, shaft 16 moves axially with respect to the housing structure 14 and the switch 10 is actuated. This disconnects the load 30 from a source of power 32. In this way, the mechanism provides a means by which several operators dispersed along the length of a machine can all actuate the switch and disconnect power to the machine by pulling on the single cable 20.

Figure 3:
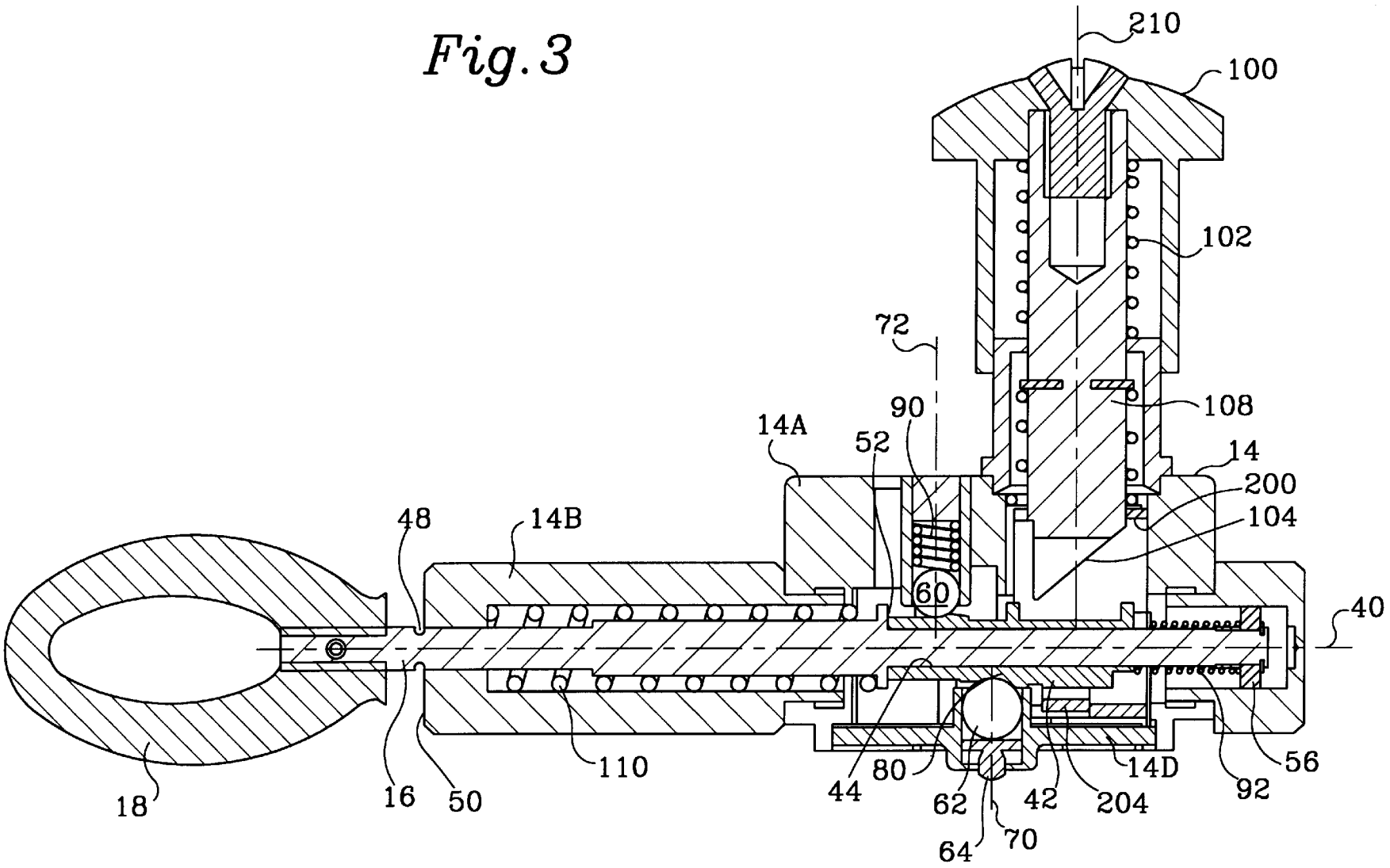
FIG. 3 is a sectional view of a switching mechanism in its normal operating condition.

FIG. 3 is a section view of a mechanism incorporating a preferred embodiment of the present invention. A housing structure 14 is provided. In the embodiment of the present invention shown in FIG. 3, the housing structure comprises a central portion 14A, one end portion 14B and another end portion 14C. In addition, a bottom portion 14D is provided to facilitate assembly of the structure shown in FIG. 3. The use of these individual components to form the housing structure facilitates the assembly of the internal components of the mechanism. A shaft 16 is slideably disposed within the housing structure 14. The shaft 16 has a central axis 40 and the shaft is disposed within the housing structure 14 to permit it to slide relative to the housing structure along the direction parallel to the central axis 40. A cam structure 42 is provided with a central opening 44 formed therethrough. The central opening 44, or bore, is shaped to receive a portion of the shaft 16 in slideable relation therein. In other words, the cam structure 42 can move axially in a direction parallel to central axis 40 relative to the shaft 16. The shaft 16 is provided with an indicating groove 48 which identifies a preferred axial position of the shaft 16 in order to facilitate set up and installation of the present invention and its associated cable. When the indicating groove 48 is generally aligned with the end 50 of the housing structure 14, the shaft 16 is in its proper operating position.

The cam structure 42 can move axially relative to shaft 16 between two limits. A cam stop surface 52 of the shaft prevents the cam structure 42 from moving farther than its location at the left extreme portion of the cam structure's travel. At the opposite end of the cam structure's travel, an end stop 56 is attached to the shaft 16.

As can be seen in FIG. 3, the cam structure 42 is provided with various specifically shaped surface portions that perform important functions in the present invention. These cam surfaces cooperate with a locking ball 60 and an operating ball 62. The operating ball 62 is associated with an operating plunger 64. In the terminology used to describe the present invention, the operating plunger 64 is also referred to as the switch operator. The switch operator 64 is movable along a second path relative to the housing structure 14 in a direction generally parallel to line 70. When the switch operator 64 is pushed downward along line 70 in FIG. 3 by the operating ball 62, it actuates a switch plunger 12 (not shown in FIG. 3). If the switch is a normally closed switch, this movement by the switch operator 64 will disconnect power from associated equipment. The locking ball 60 is movable relative to the housing structure 14 in a direction generally parallel to line 72. The locking ball 60 and the operating ball 62 operate as cam followers in response to movement of the cam surfaces of the cam structure 42. In other words, as the cam structure 42 moves left and right along central axis 40, the various indentations and protrusions of the cam surface cause the locking ball 60 and the operating ball 62 to move either toward or away from central axis 40 along their respective paths which are parallel to lines 72 and 70, respectively.

Although not shown in FIG. 3, a switch 10 such as that described above in conjunction with FIGS. 1 and 2, is attachable to the housing structure 14 in such a way that the plunger 12 of the switch is actuated by the switch operator 64. When the operating ball 62 moves downward relative to the housing structure 14 in response to movement of the cam structure 42, the switch operator 64 moves downward and protrudes through the outer surface of the housing structure 14. This pushes against the plunger 12 of an associated switch and, if the switch is normally closed, actuates it to disconnect an electrical connection. Although not illustrated in FIG. 3, a cable 20 can be attached to the end of shaft 16. This attachment can be accomplished in several ways, including a threaded eyelet 18 which is threaded onto the outer surface of the leftmost end of the shaft 16 in FIG. 3.

In FIG. 3, the cam structure 42 is provided with a sharp rise 80 in its surface. As shown in the position represented in FIG. 3, the locking ball 60 is located to the left of the sharp rise 80 and maintains the cam structure 42 in a position that permits the operating ball 62 to move upward along line 70 and retract the switch operator 64. The position shown in FIG. 3 represents a condition when the cable actuated switching mechanism is at rest, the cable is taut, the switch contacts are closed and the associated machinery is operating normally. In other words, the cable attached to the shaft 16 has neither been pulled by an operator nor broken.

If the shaft 16 is caused to move toward the left in FIG. 3 because of the cable being pulled by an operator, the end stop 56 will move toward the left and push against the cam structure 42 with sufficient force to overcome the resistance of the locking ball 60 and cause the locking ball 60 to roll over the sharp rise 80 in the cam surface. This will overcome the force of the locking spring 90 and cause the cam structure 42 to move toward the left. Subsequent to this momentary action caused by an operator pulling on the cable, the structure will be in the configuration shown in FIG. 8 which will be discussed below.

FIGS. 4A and 4B show two different perspective views of the cam structure 42. The present invention provides a modified cam structure which is different from the cam structure described in patent application Ser. No. 08/575,568, which has been discussed above. Two generally flat surfaces are provided. A first surface 180 is generally parallel to the centerline 40 through the central opening 44. A second surface 184 is generally perpendicular to the first surface 180 and is also generally perpendicular to line 40 which represents the central axis of the cam structure 42 and also of the shaft 16 as described above in FIG. 3. Since FIGS. 4A and 4B represent two different views of the same cam structure 42, several other surfaces have been identified by reference numerals 188, 190 and 192 to permit easy comparison of these two perspective views.

Figure 11B:
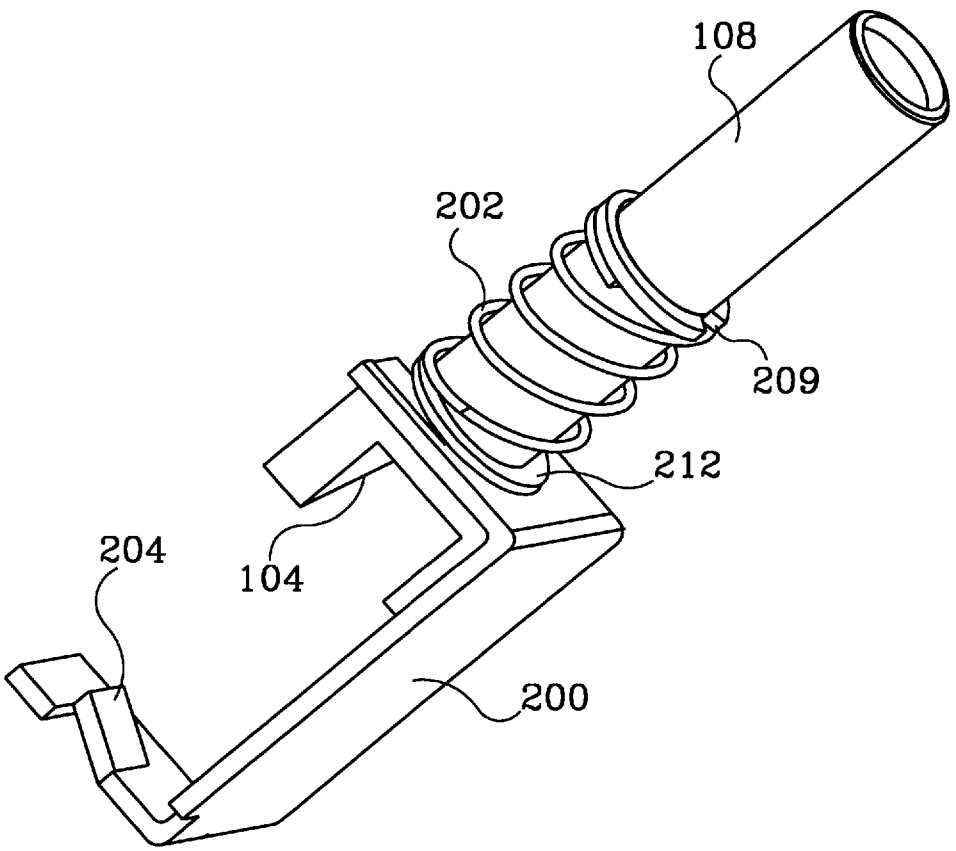
FIGS. 11A and 11B show two perspective views of the latching device in combination with the reset plunger.
Figure 11A:
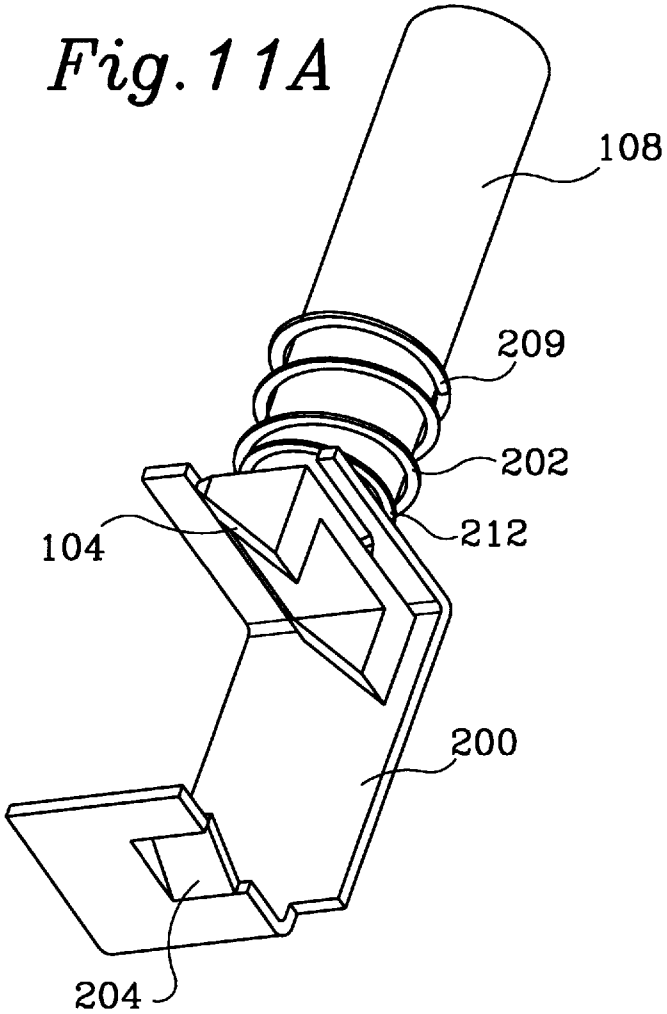

FIGS. 5A and 5B show two different perspective view of a latch device that provides the primary improvement to the cable actuated switch mechanism. The latch device 200 is provided with a tab 204. A slot 206 is shaped to receive the reset plunger 208 which is shown in FIG. 3. This arrangement is shown in FIGS. 11A and 11B and will be discussed below. The latch device 200 is thereby attached to the reset plunger 108 and moves with the rest plunger along line 210 which is illustrated in FIG. 3. In the embodiment of the present invention shown in FIGS. 5A and 5B, the tab 204 is formed by bending a portion of the latch device 200 to the angle illustrated in the Figures.

Figure 6:
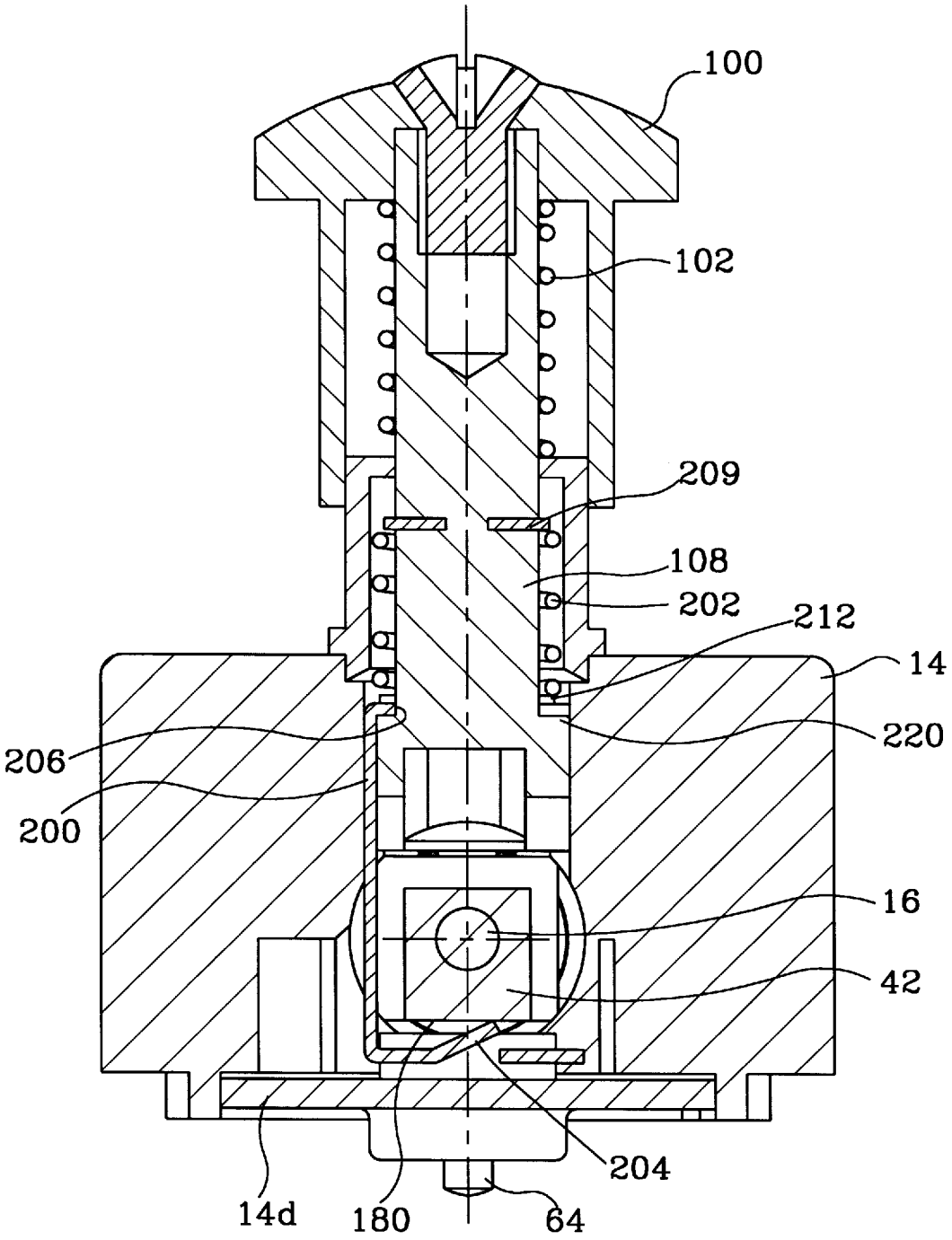
FIG. 6 is a sectional view of a cable operated switching mechanism showing the tab of a latching device in its normal operating position against a first surface.

FIG. 6 is a sectional view taken through the centerline of the reset plunger 108. It shows the tab 204 in sliding contact with the first surface 180 of the cam structure 42. As the cam structure 42 moves along axis 40, perpendicular to the surface of FIG. 6, the tax 204 slides along the first surface 180. Also shown in FIG. 6 is the connection between the reset plunger 108 and the latch device 200. The reset plunger extends through the slot 206 in the latch device 200. When the reset plunger 108 moves upward in FIG. 6, the surface contact identified by reference numeral 220 causes the reset plunger to pull the latch device 200 upward with it. Conversely, when the reset plunger moves downward in FIG. 6, the C-shaped retaining clip 209 pushes spring 202 downward against washer 212 and, as a result, the latch device 200 also moves downward in coordination with the reset plunger 108. Surface 104 of the reset mechanism, as illustrated in FIG. 3, pushes against mating surfaces on the cam structure 42 in order to force the cam structure toward the right in FIG. 3 and reset the mechanism after the cable has been pulled. With reference to FIG. 6, it should be understood that the reset plunger 108 is under continual upward force from spring 102. This continual upward force also causes the latch device 200 to experience a similar upward force because of the connection between the latch device and the reset plunger. As a result, tab 204 pushes upward against the first surface 180. This upward force exerted by the tab 204 against the first surface 180 is important because it will eventually force the latch device 200 upward when the cam structure 42 moves sufficiently toward the left in FIG. 3. This allow the tab 204 to move upward beyond the position of the first surface 180. When this occurs, the tab 204 is able to move into a locking position toward the right of the second surface 184 of the cam structure 42 in FIG. 3 and positively block and later movement toward the right by the cam structure 42 after the mechanism is initially triggered by the pulling of the cable.

Figure 7:
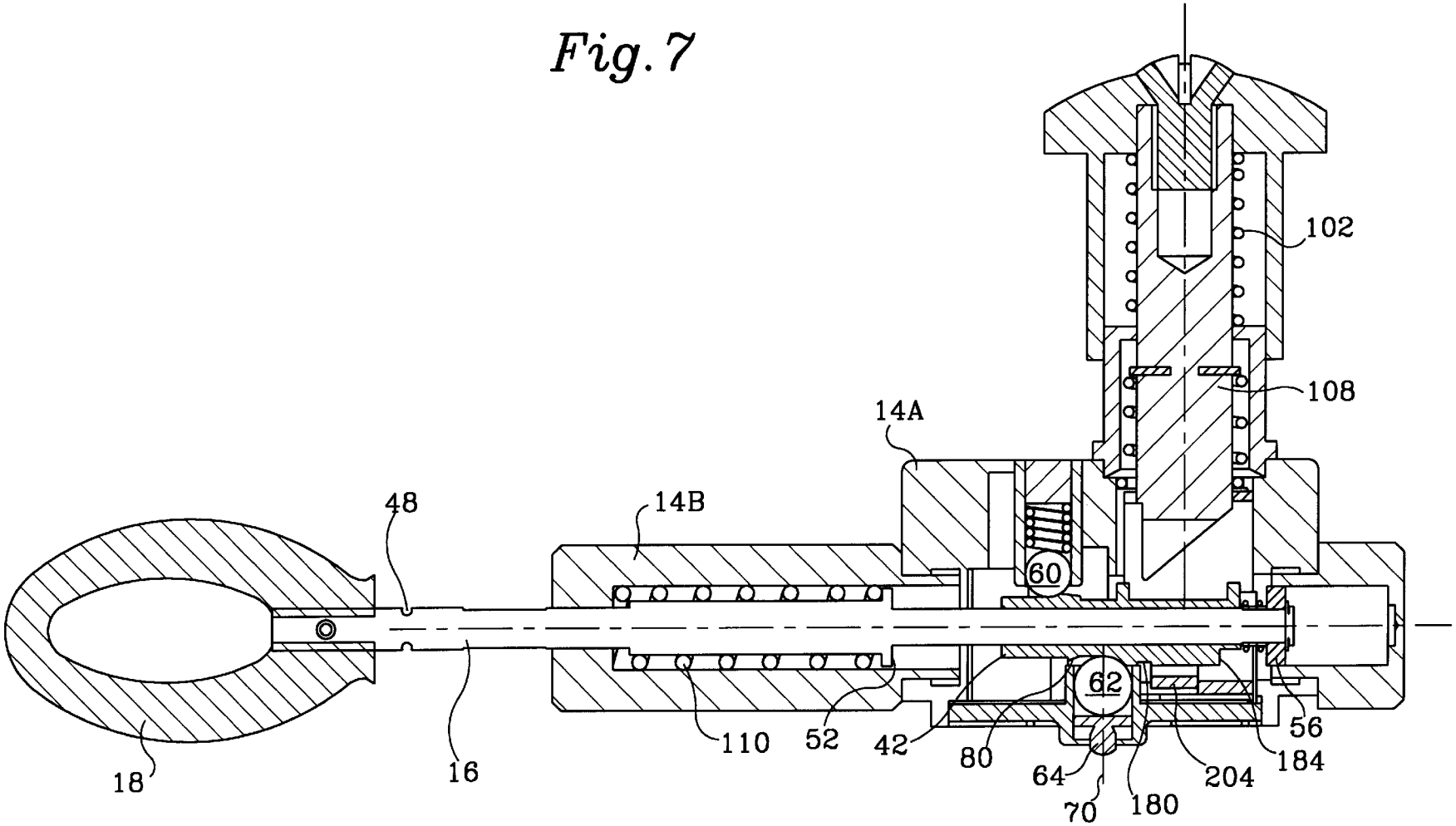
FIG. 7 shows a sectional view of the switching mechanism as a operator is pulling the cable to activate the device.

FIG. 7 shows the mechanism as the cable is being pulled to force the shaft 16 toward the left in the Figure. This causes the end stop 56 to move toward the left and push against the right end of the cam structure 42. When the end stop 56 causes the cam structure 42 to begin to move toward the left, it forces the locking ball 60 to rise over the sharp rise 80 in the surface of the cam structure. In addition, it forces the operating ball 62 downward to actuate the switch. During this procedure, as the cable is beginning to be pulled, the tab 204 continues to slide along the first surface 180 and continues to remain under the influence of the upward force exerted against the reset plunger 108 by spring 102.

Figure 8:
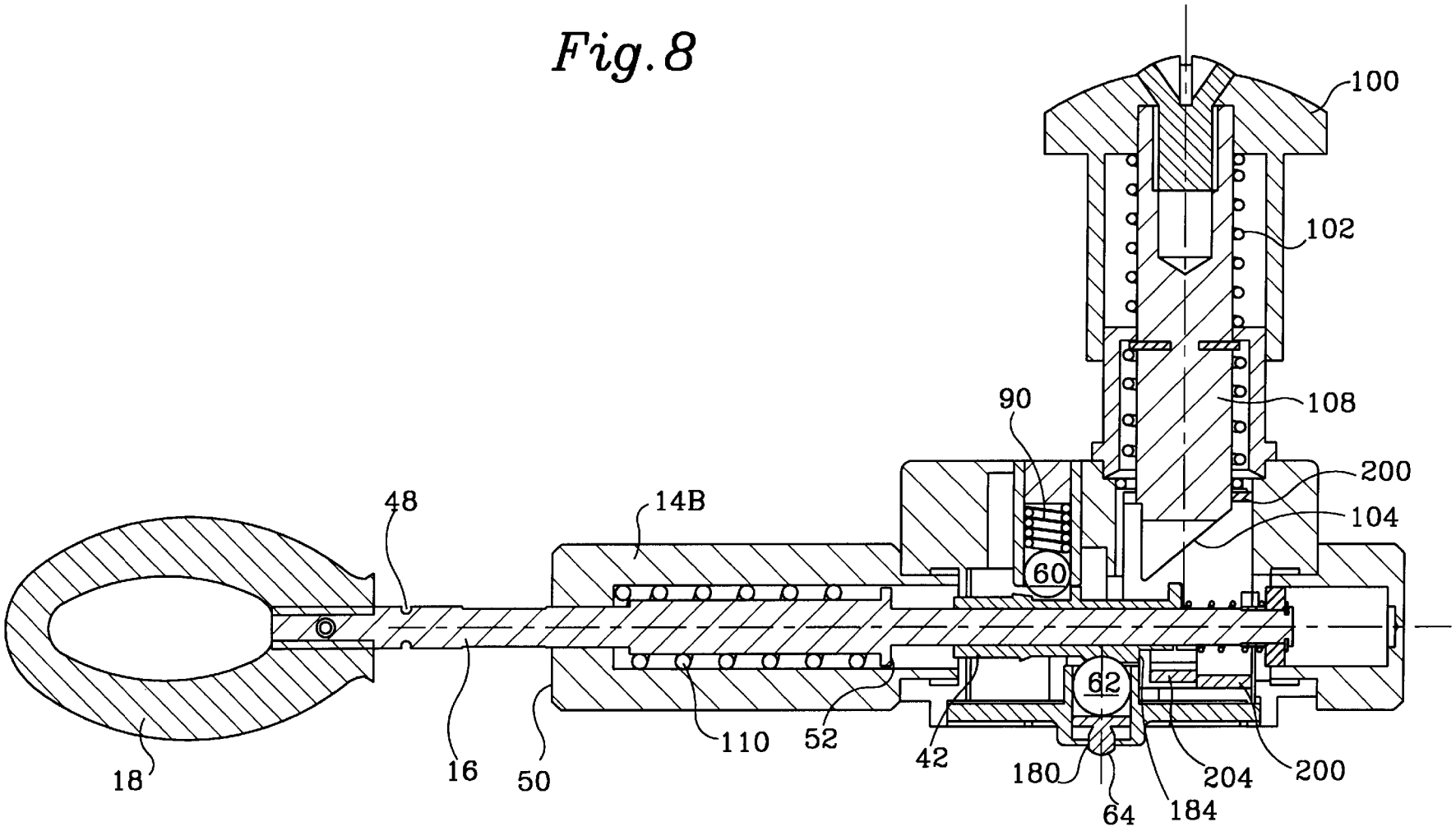
FIG. 8 shows a sectional view of the mechanism in its actuated state.

FIG. 8 shows the condition of the mechanism after the cable has been pulled by the operator and is in the process of being released. The shaft 16 would begin moving back toward the right to assume its position shown in FIG. 3 with the groove 48 disposed proximate surface 50. The tab 204 has moved, under the influence of spring 102 and reset plunger 108, upward when the second surface 184 moved to a position to the left of the left most edge of tab 204. This allowed the tab 204 and its latch device 200 to move upward in a sudden motion because of the force exerted by spring 102. When this sudden upward movement of the tab 204 has occurred, the cam structure 42 is positively prevented from returning toward the right, regardless of external forces exerted on the cam structure 42 by the shaft 16.

The presence of tab 204 at the right of the second surface 184 provides a positive stop that can not be overcome by the shaft 16 without some intentional effort on the part of an operator to depress the reset plunger 108 which causes the latch device 200 to move downward. The downward motion of the rest plunger 108 and the latch device 200 accomplishes two purposes. First, it forces the cam structure 42 back toward the right when the slanted surface 104 contacts the raised ridges of the cam structure. Secondly, it moves the latch device 200 downward and this causes tab 204 to move down to a position that allows the second surface 184 of the cam structure 42 to move toward the right and place the tab 204 back into contact with the first surface 180.

The locking ball 60 in FIG. 8 is in the depression formed to the right of the sharp rise 80 of the cam surface and the switch operator 64 is pushed downward by the operating ball 62 which, in turn, is pushed downward by the larger diameter portion of the cam surface as shown. The cam structure 42 is held in that general position by the combined action of the locking ball 60 and the cam spring 92. Upon release of the force on the cable, the shaft 16 returns to its normal position with the indicating groove 48 at its position proximate the end surface 50 of the housing structure. However, once the cam structure 42 is pushed toward its leftmost position by the end stop 56, as shown in FIG. 4, it is retained in that position by the locking ball 60 and, to some degree, by the cam spring 92. With the switch operator 64 protruding from the housing structure 14, an associated normally closed switch is actuated to deenergize an electrical circuit. This condition is in response to the operator pulling the cable to indicate an emergency stop condition. Even after the cable is released, the position of the cam structure 42 exerts a downward force on the operating ball 62 and causes the switch operator 64 to remain in the position shown in FIG. 8.

A problem can occur when the operator releases the cable after having pulled it in an emergency situation. If the cable is not installed properly with the correct amount of tension, the shaft 16 may return toward the right in FIG. 8 by a magnitude that is greater than desired. If this occurs, surface 52 of the shaft 16 can push against the cam structure 42 under influence of spring 110. Without the proper resistance provided by the cable, the strength of spring 110 can be sufficient to push against the shaft 16 and the cam structure 42 with enough force to overcome locking ball 60 and the spring force of spring 90. This could possible move locking ball 60 out of its retaining groove and allow operating ball 62 to move back into its groove. If this occurs, the switch operator 64 will move upward into the housing structure, and related switch will be deactuated and electrical current will flow through the switch. This would have the deleterious effect of providing electrical power to the equipment that had been intentionally deenergized when the operator initially pulled the cable. However, the existence of tab 204 to the right side of the second surface 184 of the cam structure 42 prevents this from occurring even if the full force of spring 110 is exerted against shaft 16 and the shaft is allowed to move into full contact with the right edge of the cam structure 42. Since tab 204 provides a positive block that is unyielding, it provides a much more secure mechanism to prevent reactivation of the switch after the cable is pulled by the operator. Although the locking ball 60 provides a resistance to the return of the cam structure 42 toward the right, that resistance can possible be overcome by the force of spring 110. The existence of tab 204, on the other hand, will not be overcome by the spring force exerted by spring 110 against shaft 16 and therefore provides a much safer means for requiring manual intervention to depress the reset plunger 108 before further operation of the machinery can occur.

A downward movement of the rest plunger 108 will cause the cam surface 104 to urge the cam structure 42 toward the right and permit the locking ball 60 to move upward along the ramp shown to its immediate left in FIG. 4 and rise above the sharp rise 80 in the cam surface. This will place the locking ball 60 on the left side of the sharp rise 80 and reset the mechanism to the condition shown in FIG. 3. Until the manual reset is accomplished in this manner, the switch operator 64 will continue to protrude from the housing structure 14 and activate the associated normally closed switch. When the reset is accomplished, the operating ball 62 will move back to the position between the two enlarged portions of the diameter of the cam structure 42, as shown in FIG. 3, and the switch operator 64 will be retracted into the housing 14. This will deactuate the associated normally closed switch and allow power to flow to the associated circuit. As the reset plunger 108 is forced downward by the operator, tab 204 is also moved downward below the plane of the first surface 180 so that the cam structure 42 can move toward the right. When the operator releases the reset button, the shaft 108 will return in an upward direction under the force of spring 102 until tab 204 moves into contact with the first surface 180.

Figure 9:
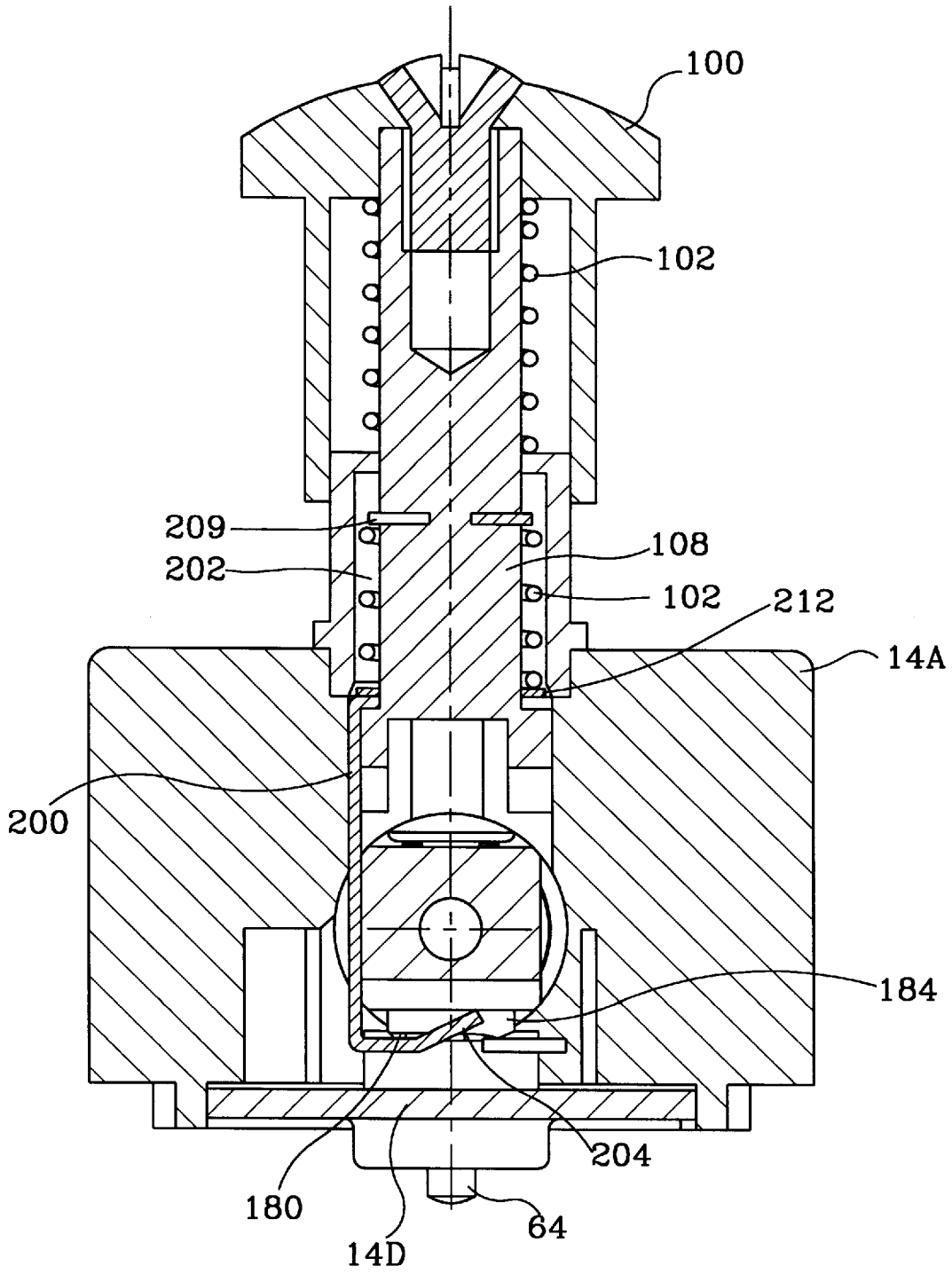
FIG. 9 is a sectional view of FIG. 8 showing the tab and latching mechanism in their activated positions which block the cam structure from returning to its operating position.

FIG. 9 is a section view taken through the center of the reset plunger 108 in FIG. 8. It shows the tab 204 moved upward above the plane of the first surface 180 and in a position to block the second surface 184 from moving through the position of the tab 204. Comparing FIGS. 6 and 9, the only difference between these illustrations is the relative positions of the latch device 200 and its tab 204 relative to the other parts of the structure. The button 100 is slightly raised in FIG. 9 by an amount generally equal to the amount by which tab 204 is raised above the plane of the first surface 180.

Figure 10:
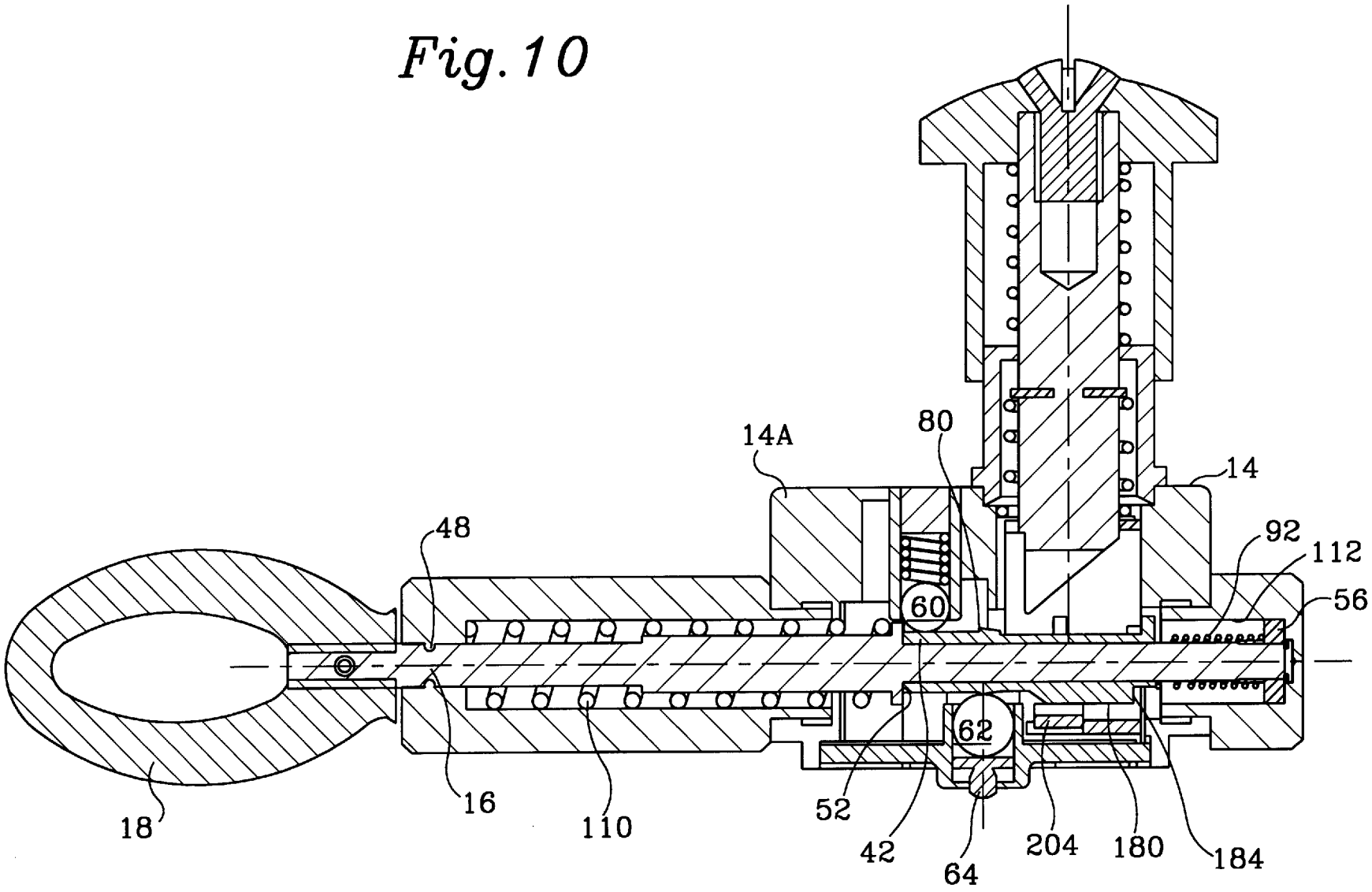
FIG. 10 shows a switching mechanism when a cable break occurs.

It is important that the features of the device that provide the locking result described above do not also prevent the mechanism from responding correctly to the presence of a broken cable. Ideally, a broken cable should result in a deenergizing of the associated electrical equipment. In order to accomplish this the switch operator 64 should be pushed downward by operating ball 62 when the cable breaks. FIG. 10 illustrates the condition of the present invention following a broken cable condition. Without the force on the shaft 16 that is normally provided by the normal cable tension, the cable tension spring 110 pushes against the left side of the shaft enlargement that also provides the cam stop surface 52. This urges the shaft 16 toward the right relative to the housing structure 14. The end stop 56 moves to its rightmost position within the bore 112 and the cam spring 92 urges the cam structure 42 against the cam stop surface 52 of the shaft. This places the sharp rise 80 of the cam surface against the operating ball 62 and pushes the switch operator 64 downward relative to the housing structure 14. When in this position, the switch operator 64 will actuate the associated normally closed switch. The only means for recovering from the situation shown in FIG. 5 is to attach the cable to its proper mooring, as shown in FIG. 2. If the cable had been broken, a new cable would be used to replace it and the tension on the cable would be adjusted to place the indicating groove 48 at its proper position relative to the end surface 50.

With reference to FIGS. 3, 7, 8 and 10, it should be understood that the representation of FIG. 3 shows the present invention in its normal operating condition. FIG. 7 shows the present invention as the cable is being pulled by an operator to indicate an emergency stop condition. FIG. 8 shows the mechanism after the cable has been pulled by an operator. FIG. 10 shows the present invention following a broken cable condition. FIGS. 4 and 5 show the present invention in situations where the associated switch is actuated to prevent power from being provided to machinery that could possibly cause damage or harm to an operator.

With reference to FIGS. 11A and 11B, the reset plunger 108 is shown in association with the latch device 200 and spring 202. In addition, the C-shaped locking member, 209 and the washer 212 are illustrated. It can be seen that a downward force against the reset plunger 108 by the reset button 106, as shown in FIG. 6, will cause the reset plunger 108 and the latch device 200 to move downward. When the latch device 200 strikes the bottom housing member identified above by reference numeral 14D, the reset plunger 108 is able to move farther downward as it compresses spring 202 and pushes the cam structure 42 into the rest position.

When cable actuated switching mechanisms are used, it is desirable that the control circuit contacts of the switch remain open until manually reset after they have been opened during an emergency stop condition. It is also desirable that the control contacts of the switch open when the cable either is broken or becomes slack beyond its useful operating tension. The control circuit contacts of the switch should also be a direct acting or a positive break design so that the mechanical force from pulling the cable will open the contacts in the event that they become welded during operation.

In the terminology used to describe the claimed invention, the housing structure 14 comprises four portions that are assembled together. These portions are identified by reference numerals 14A, 14B, 14C and 14D. The shaft 16 is slideably disposed within the housing structure 14 and is movable relative to the housing structure along a first path in a direction parallel to the axial centerline 40 of the shaft. This movement is in response to a force exerted by a cable which is identified by reference numeral 30 in FIG. 2. The cable 30 is attached to the left end of the shaft 16. A cam structure 42 has an opening 44 formed therethrough. The opening 44 is shaped to receive the shaft 16 therein in slideable relation with the cam structure 42. As shown in FIG. 3, the cam structure 42 can slide axially on the shaft 16 between the limits set by the cam stop surface 52 and the left surface of the end stop 56. A switch operator 64 is movable along a second path which is parallel to line 70 in FIG. 3. The movement along the second path is between a first position as shown in FIG. 3, with the switch operator contained within the housing structure 14, and a second position with the switch operator extending from the housing structure 14. This movement is in response to movement of the cam structure 42 in either a first direction toward the left in FIG. 3 or a second direction toward the right in FIG. 3. These movements in the first direction or second direction are along the first path which is, in turn, parallel to the central axis 40 of the shaft 16. The means for locking the switch operator 64 in the second position after the switch operator 64 moves into the second position is provided by the locking ball 60 in cooperation with the surface of the cam structure 42. The movement of the switch operator 64 into the second position can result from either of two causes. The first cause is an increased force by the cable on the shaft 16 caused by the operator pulling the cable. When the cable is pulled with a sufficient force to overcome the cable tension spring 110, the shaft 16 is moved to the left. The locking ball 60 is then disposed between the two enlarged diameter portions of the cam structure 42 and the cam structure 42 is locked in the position to hold the switch operator 64 in the extended downward position. When the mechanism is activated by an operator pulling the cable and the switch is thereby activated to deenergize the electrical power to related equipment the latching device 200 of the present invention causes tab 204 to move into a blocking position to prevent the cam structure from deactuating the switch and reenergizing the power because of a slack cable that is misadjusted and installed improperly. The other possible cause for the switch operator 64 moving into the extended downward position is the breaking of the cable. This result is illustrated in FIG. 10.

The means for resetting the mechanism has been described above and includes the plunger 108, the latch device 200, the tab 204, the palm button 100 and the plunger cam surface 104. It urges the cam structure 42 in the first direction toward the left in order to move the switch operator from the second position to the first position which is retracted into the housing structure 14. The first path, which is parallel to the central axis 40, can be perpendicular to the second path which is parallel to line 70 in a preferred embodiment of the present invention. The switch operator 64 can comprise a cam follower which is identified as the operating ball 62. The cam follower is disposed in contact with the surface of the cam structure 42. The locking means comprises the locking ball 60 which is disposed in contact with the surface of the cam structure 42.

Figure 12:
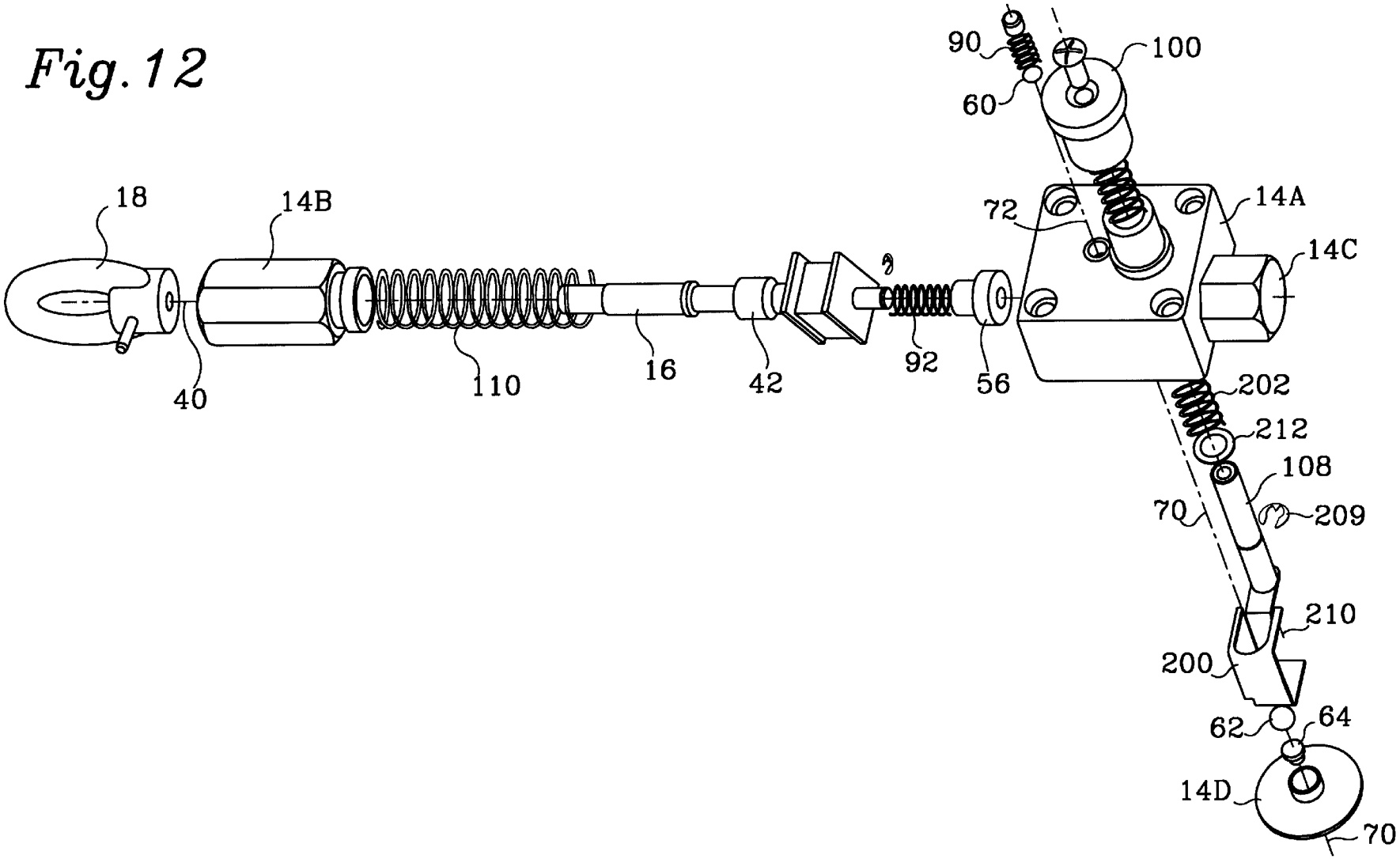
FIG. 12 shows an exploded view of all of the components of the present invention.

FIG. 12 is an exploded view of a cable operated switch mechanism made in accordance with the present invention. Reference numeral 18 identifies a means by which a cable can be connected to shaft 16. Housing portion 14B is disposed around the shaft 16 and its associated spring 110. The cam structure 42 is provided with a cylindrical opening into which a portion of the shaft 16 is disposed. The end stop 56 is attached to the end of the shaft. The reset button 100 is attached to the plunger 108 which, in turn, is attached to the latch device 200. The tab 204 of the latch device is not illustrated in FIG. 12. The locking ball 60 and the operating ball 62 are shown in conjunction with the housing structure portion identified by reference numeral 14D. All of the other reference numerals shown in FIG. 12 are described above in conjunction with the other Figures.

As described above, the present invention solves several problems that are present in known cable actuation mechanisms. It provides a mechanical snap action mechanism that locks the cam structure in position to maintain the switch operator 64 in an extended downward position after the cable is pulled momentarily. More specifically, the improvement provided by the present invention uses a latch device 200 with a tab 204 that positively prevents the return of the cam structure 42 to its normal operating position after the cable has been pulled. Rather than relying solely on the action of the locking ball 60 in its associated grooves, the improvement of the present invention is that a positive lock is provided by the tab 204 which prevents the force of spring 110 from pushing against the cam structure 42 and returning it to its normal operating position. This locking action is performed mechanically and is effective whether the switch is a snap acting switch or a slow acting switch. The present invention also reacts to a broken cable by causing the switch operator 64 to move downward and deactuate the switch. In addition, the present invention locks the cam structure 42 in the deactuating position whether it is moved into the deactuating position because of a pull by an operator on the cable or because of a broken cable.

Although the present invention has been described with particular detail to illustrate a preferred embodiment of the present invention, it should be understood that alternative embodiments are within its scope.

The embodiments of the invention in which an exclusive property or right is claimed are defined as follows:

1. A cable actuated switching mechanism, comprising:

a housing structure;

a shaft slideably disposed within said housing structure, said shaft being movable relative to said housing structure along a first path in a direction parallel to an axial centerline of said shaft in response to a force exerted by a cable attached to an end of said shaft;

a cam structure having an opening formed therethrough, said opening being shaped to receive said shaft therein in slideable relation with said cam structure;

a switch operator which is movable along a second path between a first position and a second position in response to movement of said cam structure in either a first direction or a second direction parallel to said first path;

means for locking said switch operator in said second position after said switch operator moves into said second position;

a reset plunger which is movable between a normal operating position and a resetting position, said cam structure being moved by said reset plunger to unlock said switch operator when said reset plunger is moved to said resetting position; and a latch device having a tab extending therefrom, said latch device being movable with said reset plunger, said cam structure having a first surface and a second surface, said tab being disposed in sliding association with said first surface of said cam structure when said switch operator is in said first position, said tab being disposed proximate said second surface of said cam structure when said switch operator is in said second position in response to said force being exerted by said cable, whereby said cam structure is blocked from moving said switch operator from said second position to said first position when said tab is disposed proximate said second surface unless said reset plunger is moved to said resetting position.

2. The mechanism of claim 2, further comprising:

a spring associated with said plunger to urge said reset plunger in a direction away from said centerline of said shaft.

3. The mechanism of claim 1, wherein:

said first and second surfaces of said cam structure are generally perpendicular to each other.

4. The mechanism of claim 1, further comprising;

an electrical switch attached to said housing structure, said switch being actuated when said switch operator is in said second position and deactuated when said switch operator is in said first position.

5. The mechanism of claim 1, further comprising:

first means for moving said cam structure in said first direction in order to move said switch operator into said second position in response to said force increasing beyond a first threshold magnitude; and second means for moving said cam structure in said second direction in order to move said switch operator into said second position in response to said force decreasing beyond a second threshold magnitude.

6. The mechanism of claim 5, wherein:

said first moving means comprises a first enlarged portion of said shaft which is shaped to push said cam structure in said first direction in response to movement of said shaft in said first direction.

7. The mechanism of claim 5, wherein:

said second moving means comprises a second enlarged portion of said shaft which is shaped to push said cam structure in said second direction in response to movement of said shaft in said second direction.

8. The mechanism of claim 7, wherein:

said second moving means further comprises a spring for pushing said shaft in said second direction in response to said force decreasing beyond said second threshold magnitude.

9. The mechanism of claim 1, further comprising:

means for resetting said mechanism by urging said cam structure in said first direction in order to move said switch operator from said second position to said first position.

10. The mechanism of claim 1, wherein:

said first path is perpendicular to said second path.

11. The mechanism of claim 1, wherein:

said switch operator comprises a cam follower disposed in contact with said cam structure.

12. The mechanism of claim 1, wherein:

said locking means comprises a sphere disposed in contact with said cam structure.

13. A cable actuated switching mechanism, comprising:

a housing structure;

a shaft slideably disposed within said housing structure, said shaft being movable relative to said housing structure along a first path in a direction parallel to an axial centerline of said shaft in response to a force exerted by a cable attached to an end of said shaft;

a cam structure having an opening formed therethrough, said opening being shaped to receive said shaft therein in slideable relation with said cam structure;

a switch operator which is movable along a second path between a first position and a second position in response to movement of said cam structure in either a first direction or a second direction parallel to said first path;

means for locking said switch operator in said second position after said switch operator moves into said second position;

a reset plunger which is movable between a normal operating position and a resetting position, said cam structure being moved by said reset plunger to unlock said switch operator when said reset plunger is moved to said resetting position;

a latch device having a tab extending therefrom, said latch device being movable with said reset plunger, said cam structure having a first surface and a second surface, said tab being disposed in sliding association with said first surface of said cam structure when said switch operator is in said first position, said tab being disposed proximate said second surface of said cam structure when said switch operator is in said second position in response to said force being exerted by said cable, whereby said cam structure is blocked from moving said switch operator from said second position to said first position when said tab is disposed proximate said second surface unless said reset plunger is moved to said resetting position; and a spring associated with said plunger to urge said reset plunger in a direction away from said centerline of said shaft.

14. The mechanism of claim 13, further comprising;

an electrical switch attached to said housing structure, said switch being actuated when said switch operator is in said second position and deactuated when said switch operator is in said first position.

15. The mechanism of claim 13, further comprising:

first means for moving said cam structure in said first direction in order to move said switch operator into said second position in response to said force increasing beyond a first threshold magnitude; and second means for moving said cam structure in said second direction in order to move said switch operator into said second position in response to said force decreasing beyond a second threshold magnitude.

16. The mechanism of claim 15, wherein:

said first moving means comprises a first enlarged portion of said shaft which is shaped to push said cam structure in said first direction in response to movement of said shaft in said first direction.

17. The mechanism of claim 15, wherein:

said second moving means comprises a second enlarged portion of said shaft which is shaped to push said cam structure in said second direction in response to movement of said shaft in said second direction.

18. The mechanism of claim 17, wherein:

said second moving means further comprises a spring for pushing said shaft in said second direction in response to said force decreasing beyond said second threshold magnitude.

19. The mechanism of claim 13, further comprising:

means for resetting said mechanism by urging said cam structure in said first direction in order to move said switch operator from said second position to said first position, said first path is perpendicular to said second path, said switch operator comprises a cam follower disposed in contact with said cam structure, said locking means comprises a sphere disposed in contact with said cam structure.

20. A cable actuated switching mechanism, comprising:

a housing structure;

a shaft slideably disposed within said housing structure, said shaft being movable relative to said housing structure along a first path in a direction parallel to an axial centerline of said shaft in response to a force exerted by a cable attached to an end of said shaft;

a cam structure having an opening formed therethrough, said opening being shaped to receive said shaft therein in slideable relation with said cam structure;

a switch operator which is movable along a second path between a first position and a second position in response to movement of said cam structure in either a first direction or a second direction parallel to said first path;

means for locking said switch operator in said second position after said switch operator moves into said second position;

a reset plunger which is movable between a normal operating position and a resetting position, said cam structure being moved by said reset plunger to unlock said switch operator when said reset plunger is moved to said resetting position; and a latch device having a tab extending therefrom, said latch device being movable with said reset plunger, said cam structure having a first surface and a second surface, said tab being disposed in sliding association with said first surface of said cam structure when said switch operator is in said first position, said tab being disposed proximate said second surface of said cam structure when said switch operator is in said second position in response to said force being exerted by said cable, whereby said cam structure is blocked from moving said switch operator from said second position to said first position when said tab is disposed proximate said second surface unless said reset plunger is moved to said resetting position;

a spring associated with said plunger to urge said reset plunger in a direction away from said centerline of said shaft;

an electrical switch attached to said housing structure, said switch being actuated when said switch operator is in said second position and deactuated when said switch operator is in said first position;

first means for moving said cam structure in said first direction in order to move said switch operator into said second position in response to said force increasing beyond a first threshold magnitude; and second means for moving said cam structure in said second direction in order to move said switch operator into said second position in response to said force decreasing beyond a second threshold magnitude, said first moving means comprises a first enlarged portion of said shaft which is shaped to push said cam structure in said first direction in response to movement of said shaft in said first direction, said second moving means comprising a second enlarged portion of said shaft which is shaped to push said cam structure in said second direction in response to movement of said shaft in said second direction, said second moving means further comprises a spring for pushing said shaft in said second direction in response to said force decreasing beyond said second threshold magnitude.

* * * * *